United States Patent [19]

Tarbox et al.

[11] Patent Number: 4,556,215

[45] Date of Patent: Dec. 3, 1985

[54] HAND EXERCISE WEIGHTS

[75] Inventors: Max R. Tarbox, Lubbock; Nancy Rosales, Wolfforth, both of Tex.

[73] Assignee: Tarbox, Inc., Lubbock, Tex.

[21] Appl. No.: 579,061

[22] Filed: Feb. 10, 1984

[51] Int. Cl.[4] ..... A63B 21/12

[52] U.S. Cl. ..... 272/119; 2/161 A

[58] Field of Search ..... 272/119, 93, 67; 2/161 A, 16, 20, 159, 170; D2/361; 273/54 B, 166; 128/77, 80 H

[56] References Cited

U.S. PATENT DOCUMENTS

| | | | |
|---|---|---|---|
| D. 195,134 | 4/1963 | Tarbox . | |
| D. 200,415 | 2/1965 | Tarbox . | |
| D. 218,621 | 9/1970 | Scott . | |
| D. 236,043 | 7/1975 | Carter et al. | D2/361 |
| D. 259,955 | 7/1981 | Helferich | D2/361 |
| 2,011,362 | 8/1935 | Hayward | 273/54 B X |
| 2,547,388 | 4/1951 | Griffin | D2/361 X |
| 3,203,006 | 8/1965 | Shirey | 2/161 A |
| 3,256,882 | 6/1966 | Huber | 128/165 |
| 3,369,258 | 2/1968 | Smith | D2/361 X |
| 3,490,766 | 1/1970 | Gardner | 272/119 |
| 3,525,141 | 8/1970 | Smith | 272/119 |
| 3,843,126 | 10/1974 | Bandy | 2/161 A X |
| 3,924,851 | 12/1975 | Winston | 272/119 |
| 4,034,979 | 7/1977 | Wester | 272/119 X |
| 4,247,101 | 1/1981 | Gallmeyer | 272/119 |
| 4,258,914 | 3/1981 | Lalli | 272/119 |
| 4,326,706 | 4/1982 | Guthrie et al. | 272/119 |
| 4,330,120 | 5/1982 | Netti | 272/119 |

*Primary Examiner*—Richard J. Apley
*Assistant Examiner*—Robert W. Bahr
*Attorney, Agent, or Firm*—Dowell & Dowell

[57] ABSTRACT

Exercise weights which may be comfortably worn on a person's hand in order to aid in the development of the arm and upper body muscles and which includes a band member which is fitted to encircle the hand and which includes an opening generally centrally thereof through which the person's thumb is inserted when the band member is wrapped about the hand. The band member includes at least first and second weight retaining pouches which are disposed so as to be positioned in juxtaposed relationship to the palm and back of the hand when the weights are being worn.

6 Claims, 4 Drawing Figures

HAND EXERCISE WEIGHTS

BACKGROUND OF THE INVENTION

History of the Prior Art

In order to exercise and develop the arm and upper body muscles it has been well known to utilize hand held weights such as dumbbells and the like. There are, however, problems associated with hand held weight devices. Such weights must be grasped by the fingers and thumb and thus a person using a hand held weight is not free to utilize their hands for any other purpose but engaging the weights themselves. Because such weights restrict the use of the hands, such weights may be unsuitable for use while performing other exercises, playing sports, jogging or performing daily routine tasks. Therefore, hand held weights are generally limited to use during periods of conscious weight exercising.

In an effort to give a person more freedom of movement while still providing a means for increasing the tension or stress on the body muscles, weights have been designed to be worn or secured to a person's body. Body worn weights permit an increased stress or force to be exerted on the muscles during periods of normal activity and physical exercise and thus offer the advantage of being more useful in completely conditioning the muscles.

Heretofore various types of weights have been designed to be worn on different parts of the human body. Some examples of prior art body worn weight devices include: ankle weights as disclosed in U.S. Pat. No. Des. 195,134 to Elmer Tarbox; weights worn around the wrist as shown in U.S. Pat. Nos. 3,924,851 to Herbert Winston, 4,427,101 to Richard Gallmeyer, 3,409,766 to Harris Gardner, and 4,250,914 to Ronald Lalli; belt worn weights such as disclosed in U.S. Pat. No. 3,525,141 to Gilbert Smith; head weights such as disclosed in U.S. Pat. No. 3,820,780 to Elmer Tarbox; and hand weights such as disclosed in U.S. Pat. Nos. Des. 200,415 to Elmer Tarbox, 4,326,706 to Phillip Guthrie et al., and 4,330,120 to James Netti.

Hand weights, such as those disclosed in the aforementioned patents to Guthrie and Netti, are used to develop and tone the arm and upper body muscles as a person moves his or her arms rhythmically during normal exercise, while jogging or while performing any other task. There are problems, however, associated with the use of such hand weights. As such weights are constructed in the form of gloves having portions which encircle the fingers, they restrict the movement of the fingers. Additionally, such gloves may cause discomfort to a person as the gloves prevent air circulation between the hand and glove and also tend to retain perspiration.

The type of handweights shown in the Tarbox design patent consists of a singular weight which is worn on the back of the hand and is secured by straps which extend around the hand and wrist. These weights tend to move or slip during exercise and must be continuously adjusted or repositioned on the hand. Such weights, therefore, may be somewhat awkward to use when jogging, performing aerobics, or otherwise exercising.

SUMMARY OF THE INVENTION

A weighted exercise device for wearing on a person's hand including an elongated band member having slightly tapered sides so as to be shaped to encircle the hand. The band member includes a pair of spaced weight retaining pockets which are positioned on opposite sides of a generally centrally disposed opening which is adapted to permit the user's thumb to be inserted therethrough. Cooperating adjustable strap members are attached to the outside and adjacent the ends of the band member in order to secure or adjust the fit of the exercise device to the person's hand.

It is a primary object of this invention to provide weighted exercise bands which may be adjustably worn on a person's hands in order to aid in development and toning of the arms and upper body muscles.

It is another object of this invention to provide a weighted exercise band which may be comfortably secured and retained in position around a person's hands by mounting the band so as to encompass the thumb of the hand thereby preventing shifting of the exercise device relative to the hand during periods of exercise or other hand movement.

It is a further object of the invention to provide a weighted exercise or training band which is worn on a person's hands and which is opened along the front and rear portions thereof so as to both permit air flow between the band and the user's hand and to permit unrestricted movement and use of the fingers and wrists when the band is being worn.

It is another object of the invention to provide weighted exercise bands for wearing around a person's hand wherein the weights are generally equally distributed on both sides of the hand adjacent the palm and back of the hand and are comprised of a plurality of individual small weighted particles that are loosely contained so as to permit a limited movement of particles. In this manner, the weights will conform to the surface characteristics of a person's hand during use.

DESCRIPTION OF THE PREFERRED EMBODIMENT

Figure 1:
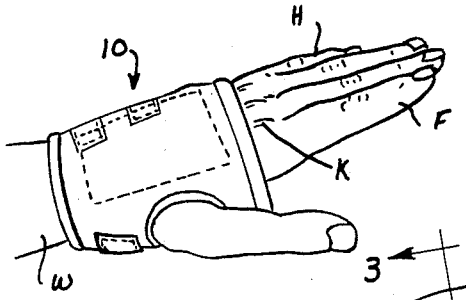
FIG. 1 is an illustration of the invention as worn on a person's left hand.

With continued reference to the drawings, the weighted exercise device 10 is shown in FIG. 1 as it is worn on a person's left hand H. In use, the exercise device extends around the hand and is positioned generally between the person's wrist W and the area adjacent the knuckles K along the base of the fingers F.

Figure 2:
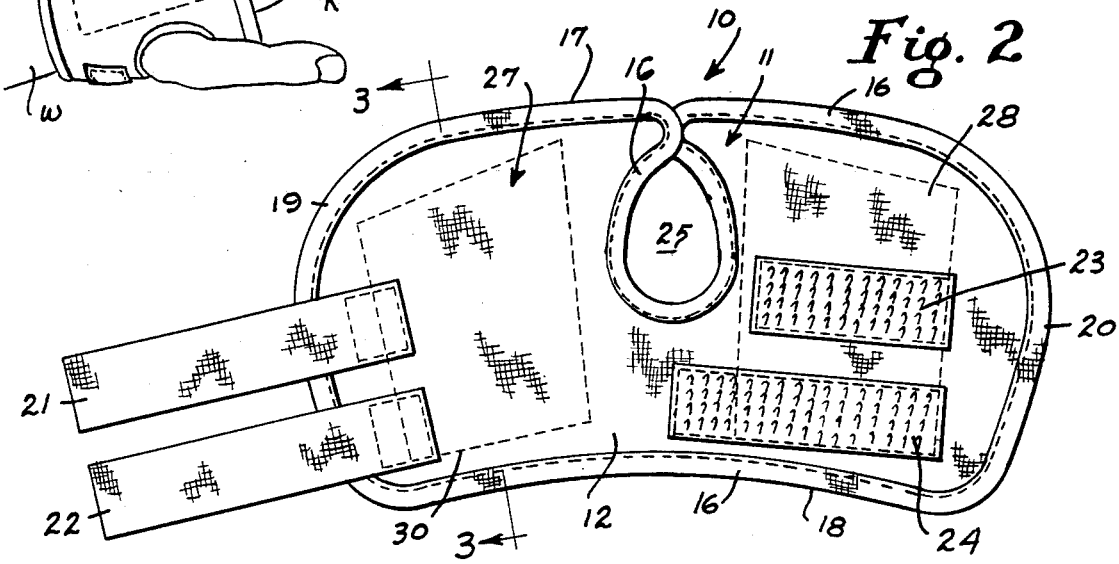
FIG. 2 is a top plan view of the weighted exercise device of the present invention.
Figure 3:
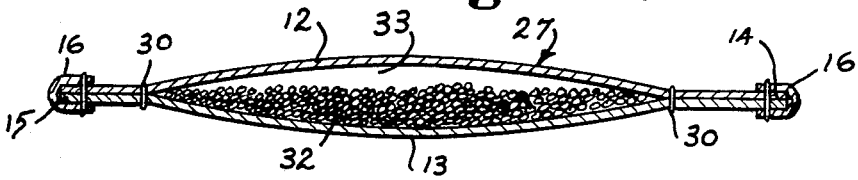
FIG. 3 is an enlarged cross-sectional view taken along lines 3–3 of FIG. 2.

As shown in FIG. 2, the exercise device 10 includes an elongated band 11 constructed of a flexible fabric material such as nylon. The band includes upper and lower fabric layers or portions 12 and 13, respectively, which are sewed together or otherwise joined at the edges to form a continuous seam 14. In order to protect and reinforce the outer edges 15 of the upper and lower fabric portions 12 and 13, a separate narrow fabric welt or border member 16 is sewed or otherwise secured over the edges.

The band 11 is defined having front and rear walls 17 and 18 and side walls 19 and 20. The front and rear walls are gently curved with front wall 17 being slightly convex in configuration and rear wall 18 being slightly concave, the front and rear walls may both, however, be formed in a generally straight line or the front wall could be convex, as shown, and the rear wall made straight. As is noted with particular reference to FIGS. 2 and 4, the side walls 19 and 20 may converge relative to one another as they extend from the front wall toward the rear wall of the band member.

By tapering the wall portions of the band, the exercise device may be made to more closely fit the hand of a person using the exercise device. When the rear wall is made shorter in length than the front wall, the device will be somewhat cone shaped when worn being of lesser diameter adjacent the rear wall and of greater diameter adjacent the front wall. Thus, the rear portion of the band will encircle the base of the person's hand adjacent the wrist and the front portion will encompass the full width of the hand adjacent the knuckles.

In order to secure the exercise device to a person's hand, a pair of straps 21 and 22 are secured to upper material layer 12 adjacent one side wall 19 of the elongated band member as shown in FIG. 2. The strap members 21 and 22 have lower surface portions covered with a material which is engageable with hook like Velcro elements which are formed on pads 23 and 24 which are secured to the upper surface 12 adjacent the other side wall portion 20. It is contemplated that other strap means or fastening means such as more conventional buckle elements could be used to secure the band around the person's hand.

Figure 4:
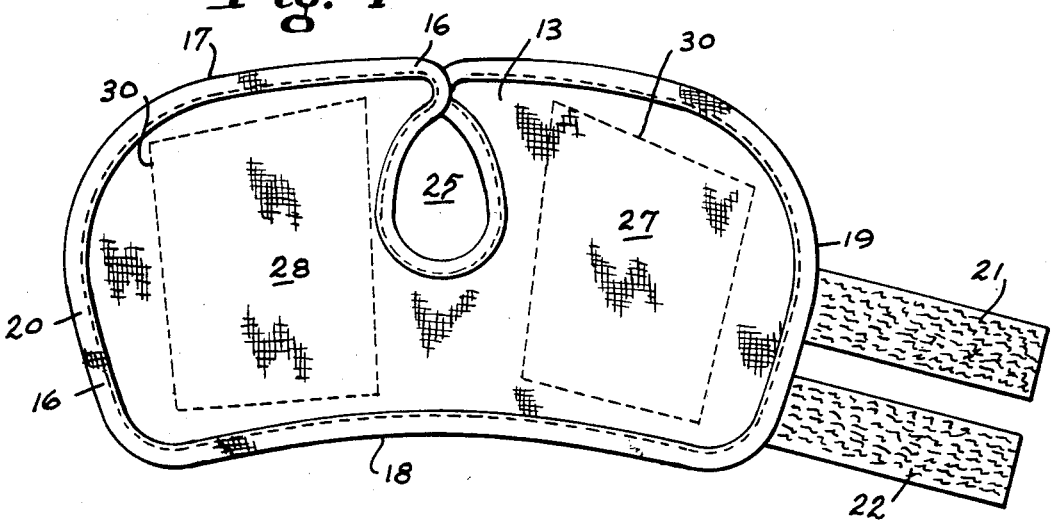
FIG. 4 is a bottom plan view of the weighted exercise of the present invention.

To positively retain the exercise device in proper position on a user's hand, an opening 25 is made through the band member 11 adjacent the central portion thereof and spaced from the front wall 17. The opening 25 is provided to permit the thumb of a user's hand to be inserted therethrough and is of a size to restrict the movement or shifting of the band member 11 with respect to the hand when the adjusting straps 21 and 22 are engaged with the Velcro hooks 23 and 24. As shown in FIGS. 2 and 4, the opening 25 may be formed by slitting the upper and lower fabric layers 12 and 13 inwardly from the front wall 17. In order to protect and reinforce the edges of the opening 25, the border member 16 may extend over such edges.

The exercise device of the present invention incorporates weight retaining pouches 27 and 28 which are formed between the upper and lower material portions 12 and 13 on opposite sides of the opening 25 so that such pockets are oriented in proper position to be situated adjacent the palm and the back of the hand, respectively, when the weight device is worn on a person's hand. As shown in the drawings, the pockets 27 and 28 are formed by stitching the upper and lower material layers together along a periphery as shown at 30. Prior to completely stitching the periphery a plurality of spherical weighted particles such as metal shot 32 are positioned within the pockets to thereby provide a weight which is free flowing within the pocket. Some excess space is provided within the pocket, as shown at 33, in order to permit the weighted particles to shift relative to one another during use so that the weights are closely contoured with the person's hand.

Although it is not shown in the drawings, it is envisioned that the weight retaining pockets 27 and 28 may be formed having a selectively operable opening such as a zipper therein which may be formed along the periphery 30 and which can be selectively opened in order to permit the introduction or removal of additional weighted particles into the pockets. In this manner the amount of weight carried by the exercise device may be selectively adjusted.

In use, the exercise band is extended outwardly and the thumb of the hand is inserted upwardly through the opening 25 from the lower layer 13 towards the upper layer 12. Thereafter, the end of the band 20 is folded under the hand into close relationship to the palm after which end 19 is brought into a proximate relationship with end 20. The straps 21 and 22 are pulled tight and placed into selective engagement with the locking hooks of the Velcro pads 23 and 24. Once the exercise device has been securely placed on the hand, a person is free to perform exercises including jogging, aerobics, and the like without the exercise device slipping from aligned engagement with the hand. As the front edge of the exercise device encircles the hand at the base of the fingers, air is permitted to flow between the exercise device and the surface of the user's hands. The movement of air between the exercise device and the hand makes the exercise device more comfortable and will prevent the build up of excessive moisture caused by perspiration. With the exercise band in place the weights are positioned adjacent the palm and back of the hands and the person's fingers and wrist are free of obstructions.

As previously noted, the exercise device as shown in the drawings is constructed for use on a person's left hand. The exercise device may be modified to be worn on the right hand by reversing the placement of the adjusting straps 21 and 22 with the locking Velcro pads 23 and 24. In this manner, the adjustable straps will always be located along the palm portion of the hand. In the event it is desirable to position the adjusting straps along the back of the hand, the positioning of the straps and the Velcro pads would be reversed for both the left and the right hand.

We claim:

1. An exercise device to be selectively worn around either of a person's hands comprising an elongated body member having upper and lower fabric layers, said elongated body member having front and rear edge portions and first and second side edge portions, an opening disposed through said upper and lower fabric layers of said body member, said opening being disposed generally centrally between said first and second side edge portions, first and second pouch means formed between said upper and lower fabric layers of said body member, said first and second pouch means being similarly shaped and formed on opposite sides of said opening and between said opening and one of said first and second side edge portions so that one of said first and second pouch means will be situated adjacent to the back of the person's hand and the other of said first and second pouch means will be positioned adjacent the palm of the person's hand, first shiftable weights carried in said first pouch means and second shiftable weights carried in said second pouch means, said first and second weights being substantially the same so that said weights are generally equally distributed along both sides of the person's hand when the device is in use, at least one fastening means for securing said first and second side edge portions in overlapping relationship with one another when said elongated body member is placed around a person's hand, said fastening means including a strap means extending outwardly from one of said first and second side edge portions of said body member, and first engaging means attached to said upper fabric layer and between said opening and the other of said first and second side edge portions of said body member, said first strap means being selectively engageable with said first engaging means to secure said body member in place around a person's hand.

2. The exercise device of claim 1 in which said first and second weights consist of a plurality of small weighted particles so that said first and second weights are movable within said first and second pouch means in order to change the contour of said first and second weights within said first and second pouch means.

3. The exercise device of claim 2 including a second fastening means, said second fastening means including a second strap means connected to said body member in spaced relationship with said first strap means and extending outwardly from said one of said first and second side edge portions in generally parallel relationship with said first strap means, second engaging means attached to said upper surface of said elongated body member between said opening and said other of said first and second side edge portions thereof, said second strap means being selectively engageable with said second engaging means.

4. The exercise device of claim 3 in which said front edge portion of said body member is convex in configuration and said rear edge portion of said body member is formed in an arcuate generally concave configuration.

5. The exercise device of claim 3 in which said first and second side edge portions taper inwardly toward one another as they extend between said front edge portion toward said rear edge portion of said elongated body member whereby said rear edge portion of said body member is of length having a dimension which is less than the length of said front edge portion of said body member.

6. The exercise device of claim 5 in which said front and rear edge portions, first and second side edge portions and said opening in said body member are reenforced by a continuous fabric border member.

* * * * *